US008640873B2

(12) United States Patent
Nakano et al.

(10) Patent No.: US 8,640,873 B2
(45) Date of Patent: Feb. 4, 2014

(54) PLASTIC AMPULE

(75) Inventors: Hideshi Nakano, Osaka (JP); Hideo Nishimura, Osaka (JP)

(73) Assignee: Nippon Zoki Pharamaceutical Co., Ltd., Osaka (JP)

( * ) Notice: Subject to any disclaimer, the term of this patent is extended or adjusted under 35 U.S.C. 154(b) by 90 days.

(21) Appl. No.: 12/937,470

(22) PCT Filed: Apr. 23, 2009

(86) PCT No.: PCT/JP2009/058103
§ 371 (c)(1),
(2), (4) Date: Oct. 12, 2010

(87) PCT Pub. No.: WO2009/131192

PCT Pub. Date: Oct. 29, 2009

(65) Prior Publication Data

US 2011/0031157 A1 Feb. 10, 2011

(30) Foreign Application Priority Data

Apr. 25, 2008 (JP) ..... 2008-115401

(51) Int. Cl.
*B65D 83/04* (2006.01)

(52) U.S. Cl.
USPC ..... 206/532; 215/48; 604/403

(58) Field of Classification Search
USPC ..... 206/535, 532; 215/47–49; 604/200, 604/212, 217, 244, 403, 416; 424/451
See application file for complete search history.

(56) References Cited

U.S. PATENT DOCUMENTS 3,356,244 A * 12/1967 Witchell ..... 215/49
3,917,120 A * 11/1975 Larenz et al. ..... 222/129
3,993,223 A * 11/1976 Welker et al. ..... 222/107
4,463,862 A * 8/1984 Hansen ..... 215/50
4,787,536 A 11/1988 Widerström
5,009,894 A * 4/1991 Hsiao ..... 424/451
5,380,534 A * 1/1995 Schurig et al. ..... 424/456
5,409,125 A * 4/1995 Kimber et al. ..... 215/48

(Continued)

FOREIGN PATENT DOCUMENTS

| | | |
|---|---|---|
| JP | B-36-005985 | 5/1961 |
| JP | YI-41-007191 | 4/1966 |
| JP | YI-41-014118 | 6/1966 |
| JP | Y2-54-037410 | 11/1979 |
| JP | A-06-218025 | 8/1994 |
| JP | A-2005-329958 | 12/2005 |
| WO | WO 2004/093775 A1 | 11/2004 |
| WO | WO 2007/003891 A1 | 1/2007 |

OTHER PUBLICATIONS

International Search Report in International Application No. PCT/JP2009/058103; dated Jul. 21, 2009; (with English-language translation).

(Continued)

*Primary Examiner* — Andrew Perreault
(74) *Attorney, Agent, or Firm* — Oliff & Berridge, PLC

(57) ABSTRACT

A plastic ampule comprising a body portion, a head portion provided continuously to the mouth portion of the body portion through a cut-off portion, and a knob portion provided continuously to the head portion the ampule being unsealed by twisting the knob portion with fingers to cut the head portion off the mouth portion, wherein the hollow portion in the head portion is formed in the shape of a bowl. Since the hollow portion is formed in the shape of a bowl, content liquid remaining in the hollow portion can be discharged easily, the plastic ampule can be unsealed easily, and the content liquid remaining in the hollow portion is not scattered easily at the time of unsealing.

12 Claims, 5 Drawing Sheets

(56) References Cited

U.S. PATENT DOCUMENTS

| | | | | |
|---|---|---|---|---|
| 5,897,008 | A | 4/1999 | Hansen | |
| 6,409,032 | B1 * | 6/2002 | Bekkers et al. | 215/48 |
| 7,540,389 | B2 * | 6/2009 | Fontana | 215/48 |
| 2004/0253039 | A1 * | 12/2004 | Stenton | 401/132 |
| 2006/0229583 | A1 | 10/2006 | Nagao et al. | |
| 2011/0196334 | A1 * | 8/2011 | Oliver | 604/416 |

OTHER PUBLICATIONS

May 18, 2012 Extended European Search Report issued in European Patent Application No. 09735213.2.

* cited by examiner

FIG. 8

TABLE FOR COMPARING REMAINING LIQUID AMOUNTS OF EMBODIMENT SAMPLE OF THE PRESENT INVENTION AND RELATED ART SAMPLE

| EXAMINER | REMAINING LIQUID AMOUNT | |
|---|---|---|
| | EMBODIMENT SAMPLE OF THE PRESENT INVENTION (BOWL SHAPE) | RELATED ART SAMPLE (STANDARD SHAPE) |
| A | 0.003 g | 0.008 g |
| B | 0.013 g | 0.031 g |
| C | 0.014 g | 0.025 g |
| D | 0.011 g | 0.038 g |
| E | 0.037 g | 0.032 g |
| AVERAGE | 0.016 g | 0.027 g |

FIG. 9

MEASUREMENT OF WALL THICKNESS OF PLASTIC AMPULE

| | EMBODIMENT SAMPLE OF THE PRESENT INVENTION (BOWL SHAPE) | | | RELATED ART SAMPLE (STANDARD SHAPE) | | |
|---|---|---|---|---|---|---|
| | LOWER PART FROM OPENING PORTION | OPENING PORTION | UPPER PART FROM OPENING PORTION | LOWER PART FROM OPENING PORTION | OPENING PORTION | UPPER PART FROM OPENING PORTION |
| 1 | 0.51 mm | 0.36 mm | 0.54 mm | 0.79 mm | 0.46 mm | 0.37 mm |
| 2 | 0.52 mm | 0.37 mm | 0.52 mm | 0.77 mm | 0.45 mm | 0.34 mm |
| 3 | 0.50 mm | 0.36 mm | 0.54 mm | 0.75 mm | 0.46 mm | 0.33 mm |
| 4 | 0.55 mm | 0.36 mm | 0.50 mm | 0.74 mm | 0.48 mm | 0.32 mm |
| 5 | 0.50 mm | 0.37 mm | 0.52 mm | 0.76 mm | 0.46 mm | 0.33 mm |
| 6 | 0.53 mm | 0.36 mm | 0.52 mm | 0.76 mm | 0.47 mm | 0.31 mm |
| AVERAGE | 0.52 mm | 0.36 mm | 0.52 mm | 0.76 mm | 0.46 mm | 0.33 mm |

PLASTIC AMPULE

TECHNICAL FIELD

The present invention relates to a plastic ampule capable of being unsealed by cutting a head portion off from a mouth portion of a body portion after filling content liquid such as a drug solution and relates to a plastic ampule filled with a drug solution using such plastic ampule.

BACKGROUND ART

Conventionally, various ampules made of glass, plastic, or the like have been developed for sealing a drug solution for injection and the like and are practically used. However, the demand for the plastic ampule increases for the safe handling and convenience. In addition, the manufacturing process of the ampule preparation for injection or the like that is the plastic ampule filled with a drug solution employs a so-called blow-fill-seal method in which the step for molding the plastic ampules and the step for filling the content liquid are sequentially performed because the process requires filling the content liquid such as a drug solution as one of the steps.

When a conventional plastic ampule is manufactured by the blow-fill-seal method, as shown in FIG. 6, a plurality of plastic ampules 1*a* may be formed continuously via thin-wall portions for division 13*a* to manufacture them as the shape of a plastic ampule block. When the plastic ampules are manufactured as the shape of a plastic ampule block, each of the plastic ampules 1*a* is divided along the thin-wall portion for division 13*a* formed in the plastic ampule block to be used. Furthermore, in the conventional plastic ampule 1*a*, a head portion 6*a* is formed continuously to a mouth portion 3*a* of a body portion 2*a* via a cut-off portion 10*a*, and a hollow is formed in the head portion 6*a* to communicate with the mouth portion 3*a* (that is, with the body portion 2*a*). Then, in order to reliably open the mouth portion 3*a* of the body portion 2*a*, the cut-off portion 10*a* that communicates the head portion 6*a* with the body portion 2*a* is formed so as to have a neck-down shape.

In the conventional plastic ampule 1*a* shown in FIG. 6, as an enlarged view shown in FIG. 4(B), the head portion 6*a* is formed so as to have a substantially pentagon as the cross section shape along the flat surface of a knob portion 9*a*, and the hollow portion 8*a* is formed to have substantially the same shape in the head portion 6*a*. Furthermore, the lower end of the head portion 6*a* is formed continuously to the mouth portion 3*a* via the cut-off portion 10*a*, and when the knob portion 9*a* that is integral with the head portion 6*a* is twisted with fingers to cut the head portion 6*a* off from the mouth portion 3*a*, an opening portion 4*a* is formed at the upper end of the mouth portion 3*a*. In this case, the opening portion 4*a* is similarly formed at the lower end of the head portion 6*a*. The lower end of the head portion 6*a* is formed so as to have a substantially straight line that is parallel to the cut-off portion 10*a*. Furthermore, when the plastic ampule is manufactured by the blow-fill-seal method or the like, as shown in FIG. 7(B), the lower end (near the cut-off portion) of the head portion 6*a* that is formed continuously to the cut-off portion 10*a* is formed to have a wall thickness p thinner than the wall thickness q of the upper end (near the cut-off portion) of the mouth portion 3*a* ($p<q$).

Furthermore, FIG. 4(C) shows another conventional plastic ampule in which a head portion 6*b* is formed to have a substantially semicircle shape as the cross section shape along the flat surface of a knob portion 9*b*, and a hollow portion 8*b* is formed to have the same shape in the head portion 6*b*. In the plastic ampule, the lower end of the head portion 6*b* is formed continuously to a mouth portion 3*b* via a cut-off portion 10*b*. When the knob portion 9*b* that is integral with the head portion 6*b* is twisted with fingers to cut the head portion 6*b* off from the mouth portion 3*b*, an opening portion 4*b* is formed at the upper end of the mouth portion 3*b*, and the opening portion 4*b* is formed at the lower end of the head portion 6*b*. Also in this ampule, the lower end of the head portion 6*b* is formed so as to have a substantially straight line that is parallel to the cut-off portion 10*b*. Also in this case, as with the case of the plastic ampules in FIG. 6, when the plastic ampule is manufactured by the blow-fill-seal method or the like, as shown in FIG. 7(C), the lower end (near the cut-off portion) of the head portion 6*b* that is formed continuously to the cut-off portion 10*b* is formed to have a wall thickness p thinner than the wall thickness q of the upper end (near the cut-off portion) of the mouth portion 3*b* ($p<q$).

A similar plastic ampule to the plastic ampule 1*a* shown in FIG. 6 is disclosed in Patent Document 1. Patent Document 1 discloses that a plurality of plastic ampules are formed continuously via connection portions to form a plastic ampule block and that each of the plastic ampules has a fused portion between the mouth portion and the head portion (grip portion). In the plastic ampule of Patent Document 1, the connection portion is formed from the container body portion to the grip portion and the fused portion does not have a reduced diameter. Furthermore, the head portion is formed to have a substantially pentagon as the cross section shape along the flat surface of the grip portion, and the lower end of the head portion is formed to have a substantially straight line that is parallel to the fused portion, but there is no description about the wall thickness near the fused portion.

As a conventional plastic ampule, Patent Document 2 discloses a plastic ampule in which a plurality of synthetic resin ampules are formed continuously via thin-wall portions to form a synthetic resin ampule block, in each of the synthetic resin ampules, a twist-off portion is formed between a shoulder portion and a narrow neck portion, and a thin-wall portion is formed on a plate portion that is formed upwardly and downwardly across the twist-off portion, along the straight line on the twist-off portion. The narrow neck portion in Patent Document 2 is formed to have a substantially pentagon as the cross section shape along the flat surface of the plate portion, and the lower part of the narrow neck portion has a reduced diameter as an inverted cone shape. As a result, a whole narrow neck portion does not have a bowl shape, and, as shown in FIG. 3 of the literature, the twist-off portion has almost the same wall thickness as that near the upper part.

As a conventional plastic ampule, Patent Document 3 discloses a plastic ampule in which a breaking site is formed between a head having a toggle and a neck of an ampule body and in which the toggle is twisted or bent to separate the head from the neck along the breaking site. The head in Patent Document 3 is formed to have an ellipse as the cross section shape along the flat surface of the toggle. Furthermore, as shown in FIG. 3 of the literature, the head has almost the same wall thickness as that of the neck.

RELATED ART DOCUMENTS

Patent Documents

Patent Document 1: WO 2004/093775

Patent Document 2: Japanese Examined Utility Model Application Publication No. 54-37410

Patent Document 3: Japanese Patent Application Publication No. JP-A-6-218025

DISCLOSURE OF THE INVENTION

Problem to be Solved by the Invention

As shown in FIG. 4(B), because the head portion of the plastic ampule in FIG. 6 or Patent Document 1 is formed to have a substantially pentagon shape as the cross section shape in the perpendicular direction of the hollow portion and the lower end of the head portion is formed to have a substantially straight line parallel to the cut-off portion, even when the removal operation of the content liquid remaining in the hollow portion (the operation of shaking the plastic ampule with the ampule held with a hand with the head portion up before use so as to drop the content liquid remaining in the hollow portion into the body portion) is carried out, it is difficult to remove the content liquid remaining in the hollow portion. Thus, the plastic ampule has problems that the content liquid remaining in the hollow portion is not used and lost, and the content liquid remaining in the hollow portion is readily scattered at the time of unsealing the plastic ampule. In particular, in the case of the plastic ampule having a maximum filling volume of about 5 mL to 20 mL, because the hollow portion cannot have enough dimension in the vertical direction, the content liquid that comes into the hollow portion readily adheres to the inner surface of the hollow portion and cannot be removed easily. Furthermore, as with the plastic ampules shown in Patent Document 1 or FIG. 6 (FIG. 4(B)), the plastic ampule shown in FIG. 4(C) also has the problems that, because the head portion is formed to have the hollow portion with a substantially semicircle shape as the cross section shape and the lower end of the head portion is formed to have a substantially straight line parallel to the cut-off portion, the content liquid remains in the hollow portion and is readily scattered at the time of unsealing.

Furthermore, in the synthetic resin ampule in Patent Document 2, because the narrow neck portion (corresponding to the hollow portion of the present invention) is formed to have a substantially pentagon as the cross section shape in the perpendicular direction, and the lower part of the narrow neck portion has a reduced diameter as an inverted cone shape, discharging performance of the content liquid remaining in the narrow neck portion is supposed to be better than that of the plastic ampule in FIG. 6 (FIG. 4(B)). However, in particular, in the case of the synthetic resin ampule having a volume of about 5 mL to 20 mL, because the narrow neck portion cannot have enough dimension in the vertical direction, as with the plastic ampules shown in Patent Document 1 and FIG. 6 (FIGS. 4(B) and (C)), the content liquid remaining in the narrow neck portion adheres to the inner surface of the narrow neck portion and cannot be removed easily.

Furthermore, in the plastic ampule in Patent Document 3, as shown in FIG. 1 of Patent Document 3, because the head (corresponding to the hollow portion of the present invention) is formed to have a substantially ellipse as the cross section shape in the perpendicular direction, the discharging performance of the content liquid remaining in the head is supposed to be better than that of the plastic ampules in FIG. 6 (FIGS. 4(B) and (C)). However, in the case of plastic ampule having a volume of about 5 mL to 20 mL, because the head cannot have enough volume, as with the synthetic resin ampule shown in Patent Document 2, the content liquid remaining in the head adheres to the inner surface of the head and cannot be removed easily.

Furthermore, in the conventional plastic ampules in FIGS. 4(B) and (C) and the plastic ampules in Patent Documents 1 and 2, because the lower end (near the cut-off portion) of the head portion that is formed continuously to the cut-off portion is formed to have a wall thickness equal to or thinner than the wall thickness of the upper end (near the cut-off portion) of the mouth portion, when the knob portion that is integral with the head portion is twisted at the time of unsealing the plastic ampule, the lower end of the head portion is deformed, and thus the enough twisting force is not readily transferred to the cut-off portion. Thus, the twisting off the head portion is more difficult than expected to cause inconvenience and disadvantage in the medical practice. In particular, at the last of the twisting off, a single piece of string-like plastic may connect the head portion to the body portion, and it may be difficult to break the string-like plastic. Furthermore, by the action of the deformed lower end of the head portion returning to the original shape immediately after unsealing, the content liquid remaining in the hollow portion in the head portion may be scattered.

In view of the above, it is an object of the present invention to provide a plastic ampule by which the content liquid remaining in the hollow portion of the head portion is readily dropped into the body portion by the removal operation of shaking the plastic ampule before use and thus a large part of the content liquid can be used and to provide a plastic ampule filled with a drug solution using such plastic ampule. Furthermore, it is an object of the present invention to provide a plastic ampule that is more readily unsealed than conventional ampules because its hollow portion is formed to have a bowl shape, and by which the content liquid remaining in the hollow portion is not readily scattered at the time of unsealing because its hollow portion is less deformed at the time of unsealing and to provide a plastic ampule filled with a drug solution using such plastic ampule.

Means for Solving the Problem

In order to solve the problem, the invention according to a plastic ampule of the present invention is characterized by including a body portion, a head portion formed continuously to a mouth portion of the body portion via a cut-off portion, and a knob portion formed continuously to the head portion, the plastic ampule being unsealed by twisting the knob portion and cutting the head portion off from the mouth portion, in which a hollow portion in the head portion is formed to have a bowl shape and a part of the head portion formed continuously to the cut-off portion is formed to have a wall thickness thicker than that of the cut-off portion.

Hereinafter, preferred aspects of the plastic ampule of the present invention will be described as follows, but the invention is not limited to them.

(Aspect 1) A plastic ampule is characterized by including a body portion, a head portion formed continuously to a mouth portion of the body portion via a cut-off portion, and a knob portion formed continuously to the head portion. The plastic ampule is unsealed by twisting the knob portion and cutting the head portion off from the mouth portion. In the plastic ampule, a hollow portion in the head portion is formed to have a bowl shape.

(Aspect 2) The plastic ampule according to aspect 1 is characterized in that the hollow portion is formed to have a minimum vertical dimension of 3 mm to 10 mm.

(Aspect 3) The plastic ampule according to aspect 2 is characterized in that the hollow portion is formed to have a maximum vertical dimension of 4 mm to 13 mm.

(Aspect 4) The plastic ampule according to aspect 2 or 3 is characterized in that the hollow portion is formed to have a maximum horizontal dimension of 8 mm to 12 mm.

(Aspect 5) The plastic ampule according to any one of aspects 2 to 4 is characterized in that an opening portion formed on the head portion when the head portion is cut off from the mouth portion is formed to have an inner diameter of 4 mm to 7 mm.

(Aspect 6) The plastic ampule according to aspect 5 is characterized in that the hollow portion is formed to have a minimum vertical dimension equal to or larger than the inner diameter of the opening portion.

(Aspect 7) A plastic ampule is characterized by including a body portion, a head portion formed continuously to a mouth portion of the body portion via a cut-off portion, and a knob portion formed continuously to the head portion. The plastic ampule is unsealed by twisting the knob portion and cutting the head portion off from the mouth portion. In the plastic ampule, a hollow portion in the head portion is formed to have a bowl shape, and the hollow portion is formed to have a minimum vertical dimension of 3 mm to 10 mm, a maximum vertical dimension of 4 mm to 13 mm, and a maximum horizontal dimension of 8 mm to 12 mm, and an opening portion formed on the head portion when the head portion is cut off from the mouth portion is formed to have an inner diameter of 4 mm to 7 mm.

(Aspect 8) The plastic ampule according to aspect 1 is characterized in that the hollow portion is formed to have a minimum vertical dimension of 4 mm to 10 mm.

(Aspect 9) The plastic ampule according to aspect 1 is characterized in that the hollow portion is formed to have a minimum vertical dimension of 5 mm to 10 mm.

(Aspect 10) The plastic ampule according to aspect 1 is characterized in that the hollow portion is formed to have a minimum vertical dimension of 5.5 mm to 8.5 mm.

(Aspect 11) The plastic ampule according to any one of aspects 8 to 10 is characterized in that the hollow portion is formed to have a maximum vertical dimension of 5 mm to 13 mm.

(Aspect 12) The plastic ampule according to any one of aspects 8 to 10 is characterized in that the hollow portion is formed to have a maximum vertical dimension of 6 mm to 12 mm.

(Aspect 13) The plastic ampule according to any one of aspects 8 to 12 is characterized in that the hollow portion is formed to have a maximum horizontal dimension of 9 mm to 11 mm.

(Aspect 14) The plastic ampule according to any one of aspects 8 to 13 is characterized in that an opening portion formed on the head portion when the head portion is cut off from the mouth portion is formed to have an inner diameter of 5 mm to 6 mm.

(Aspect 15) The plastic ampule according to aspect 14 is characterized in that the hollow portion is formed to have a minimum vertical dimension equal to or larger than the inner diameter of the opening portion.

(Aspect 16) A plastic ampule is characterized by including a body portion, a head portion formed continuously to a mouth portion of the body portion via a cut-off portion, and a knob portion formed continuously to the head portion. The plastic ampule is unsealed by twisting the knob portion and cutting the head portion off the mouth portion. In the plastic ampule, a hollow portion in the head portion is formed to have a bowl shape, and the hollow portion is formed to have a minimum vertical dimension of 4 mm to 10 mm, a maximum vertical dimension of 5 mm to 13 mm, and a maximum horizontal dimension of 9 mm to 11 mm, and an opening portion formed on the head portion when the head portion is cut off from the mouth portion is formed to have an inner diameter of 5 mm to 6 mm.

(Aspect 17) The plastic ampule according to any one of aspects 1 to 16 is characterized in that the material is a polyethylene resin.

(Aspect 18) The plastic ampule according to any one of aspects 1 to 17 is characterized in that a plastic ampule block is formed by continuously forming a plurality of the plastic ampules via a thin-wall portion for division.

(Aspect 19) The plastic ampule according to aspect 18 is characterized in that the adjacent plastic ampules are separated between the respective knob portions.

(Aspect 20) The plastic ampule according to any one of aspects 1 to 19 is characterized in that a part of the head portion formed continuously to the cut-off portion is formed to have a wall thickness thicker than that of the cut-off portion.

(Aspect 21) The plastic ampule according to aspect 20 is characterized in that the part of the head portion formed continuously to the cut-off portion is formed to have a wall thickness 1.2 times to 1.8 times thicker than that of the cut-off portion.

(Aspect 22) The plastic ampule according to aspect 20 or 21 is characterized in that the part of the head portion formed continuously to the cut-off portion is formed to have almost the same wall thickness as that of a part of the mouth portion formed continuously to the cut-off portion.

(Aspect 23) A plastic ampule filled with a drug solution is characterized by including a body portion, a head portion formed continuously to a mouth portion of the body portion via a cut-off portion, and a knob portion formed continuously to the head portion. The plastic ampule is unsealed by twisting the knob portion and cutting the head portion off from the mouth portion. In the plastic ampule, a hollow portion in the head portion is formed to have a bowl shape.

(Aspect 24) A plastic ampule filled with a drug solution is characterized by including a body portion, a head portion formed continuously to a mouth portion of the body portion via a cut-off portion, and a knob portion formed continuously to the head portion. The plastic ampule is unsealed by twisting the knob portion and cutting the head portion off from the mouth portion. In the plastic ampule, a hollow portion in the head portion is formed to have a bowl shape, and the hollow portion is formed to have a minimum vertical dimension of 3 mm to 10 mm, a maximum vertical dimension of 4 mm to 13 mm, and a maximum horizontal dimension of 8 mm to 12 mm, and an opening portion formed on the head portion when the head portion is cut off from the mouth portion is formed to have an inner diameter of 4 mm to 7 mm.

(Aspect 25) A plastic ampule filled with a drug solution is characterized by including a body portion, a head portion formed continuously to a mouth portion of the body portion via a cut-off portion, and a knob portion formed continuously to the head portion. The plastic ampule is unsealed by twisting the knob portion and cutting the head portion off from the mouth portion. In the plastic ampule, a hollow portion in the head portion is formed to have a bowl shape, and the hollow portion is formed to have a minimum vertical dimension of 4 mm to 10 mm, a maximum vertical dimension of 5 mm to 13 mm, and a maximum horizontal dimension of 9 mm to 11 mm, and an opening portion formed on the head portion when the head portion is cut off from the mouth portion is formed to have an inner diameter of 5 mm to 6 mm.

(Aspect 26) The plastic ampule filled with a drug solution according to aspect 23 is characterized in that the plastic ampule as described in any one of aspects 2 to 6, 8 to 15, and 17 to 22 is used.

(Aspect 27) The plastic ampule filled with a drug solution according to aspect 26 is characterized in that the drug solution is an aqueous injection fluid.

(Aspect 28) The plastic ampule filled with a drug solution according to aspect 26 is characterized in that the drug solution is an injection suspension or emulsion.

The present invention is basically characterized by the aspects above. The hollow portion in the head portion of the plastic ampule is characterized by having the shape by which the content liquid remaining in the hollow portion in the head portion of the plastic ampule can be readily discharged by the removal operation and has a bowl shape as the basic shape. Considering discharging characteristics of the content liquid filled in the plastic ampule, the hollow portion in the head portion of the plastic ampule in the present invention preferably has at least a minimum vertical dimension by which the content liquid remaining in the hollow portion can be readily discharged by the removal operation. In particular, in the case of a plastic ampule having a maximum filling volume of 5 mL to 20 mL, the hollow portion has a minimum vertical dimension of 3 mm or more, preferably 4 mm or more, and more preferably 5 mm or more, and the opening portion preferably has an inner diameter of 4 mm or more.

Furthermore, the present invention is characterized by having the shape by which the plastic ample can be readily unsealed. That is, as shown in FIG. 7(A), the part of the head portion that is formed continuously to the cut-off portion is formed to have a wall thickness p thicker than a wall thickness q of the cut-off portion (p>q). In particular, in the plastic ampule in the present invention, the part of the head portion that is formed continuously to the cut-off portion is preferably formed to have the wall thickness p 1.2 times to 1.8 times thicker than the wall thickness q of the cut-off portion.

Effects of the Invention

According to the invention pertaining to the plastic ampule of the present invention (aspect 1), because the hollow portion in the head portion that is formed continuously to the mouth portion of the body portion is formed to have a bowl shape, the content liquid remaining in the hollow portion in the head portion can be readily dropped into the body portion by a removal operation, and thus a large part of the content liquid can be used, and the content liquid remaining in the hollow portion is not scattered at the time of unsealing. Therefore, the formation can provide a plastic ampule having excellent unsealing performance and easy handling.

According to the invention pertaining to the plastic ampule described in aspect 2, in addition to the effect of the invention of aspect 1, because the hollow portion is formed to have a minimum vertical dimension of 3 mm to 10 mm, even when the content liquid forms a drop in the hollow portion, the content liquid remaining in the hollow portion can be readily removed by the removal operation. Therefore, a plastic ampule that has better discharging performance by which no content liquid remains in the hollow portion and that has excellent unsealing performance and easy handling can be provided.

According to the invention pertaining to the plastic ampule described in aspect 3, in addition to the effect of the invention of aspect 2, because the hollow portion is formed to have a maximum vertical dimension of 4 mm to 13 mm, even when the content liquid forms a drop in the hollow portion, the content liquid remaining in the hollow portion can be further readily removed by the removal operation. Therefore, a plastic ampule that has better discharging performance by which no content liquid remains in the hollow portion and that has excellent unsealing performance and easy handling can be provided.

According to the invention pertaining to the plastic ampule described in aspect 4, in addition to the effect of the invention of aspect 2 or 3, because the hollow portion is formed to have a maximum horizontal dimension of 8 mm to 12 mm, even when the content liquid forms a drop in the hollow portion, the content liquid remaining in the hollow portion can be further readily removed by the removal operation. Therefore, a plastic ampule that has better discharging performance by which no content liquid remains in the hollow portion and that has excellent unsealing performance and easy handling can be provided.

According to the invention pertaining to the plastic ampule described in aspect 5, in addition to the effect of the invention of any one of aspects 2 to 4, because the opening portion formed on the head portion when the head portion is cut off from the mouth portion is formed to have an inner diameter of 4 mm to 7 mm, even when the content liquid forms a drop in the hollow portion, the content liquid remaining in the hollow portion can be further readily removed by the removal operation. Therefore, a plastic ampule that has better discharging performance by which no content liquid remains in the hollow portion and that has excellent unsealing performance and easy handling can be provided.

According to the invention pertaining to the plastic ampule described in aspect 6, in addition to the effect of the invention of aspect 5, because the hollow portion is formed to have a minimum vertical dimension equal to or larger than the inner diameter of the opening portion, even when the content liquid forms a drop in the hollow portion, the content liquid remaining in the hollow portion can be further readily removed by the removal operation. Therefore, a plastic ampule that has better discharging performance by which no content liquid remains in the hollow portion and that has excellent unsealing performance and easy handling can be provided.

According to the invention pertaining to the plastic ampule described in aspect 7, because the hollow portion in the head portion is formed to have a bowl shape, and the hollow portion is formed to have a minimum vertical dimension of 3 mm to 10 mm, a maximum vertical dimension of 4 mm to 13 mm, and a maximum horizontal dimension of 8 mm to 12 mm, and the opening portion formed on the head portion when the head portion is cut off from the mouth portion is formed to have an inner diameter of 4 mm to 7 mm, the discharging performance is good, and no content liquid remains in the hollow portion. Therefore, the formation can provide a plastic ampule having excellent unsealing performance and easy handling.

According to the invention pertaining to the plastic ampule described in aspect 8, in addition to the effect of the invention of aspect 1, because the hollow portion is formed to have a minimum vertical dimension of 4 mm to 10 mm, even when the content liquid forms a drop in the hollow portion, the content liquid remaining in the hollow portion can be readily removed by the removal operation. Therefore, a plastic ampule that has better discharging performance by which no content liquid remains in the hollow portion and that has excellent unsealing performance and easy handling can be provided.

According to the invention pertaining to the plastic ampule described in aspect 9, in addition to the effect of the invention of aspect 1, because the hollow portion is formed to have a minimum vertical dimension of 5 mm to 10 mm, even when the content liquid forms a drop in the hollow portion, the content liquid remaining in the hollow portion can be readily removed by the removal operation. Therefore, a plastic ampule that has even better discharging performance by which no content liquid remains in the hollow portion and that has excellent unsealing performance and easy handling can be provided.

According to the invention pertaining to the plastic ampule described in aspect 10, in addition to the effect of the invention of aspect 1, because the hollow portion is formed to have a minimum vertical dimension of 5.5 mm to 8.5 mm, even when the content liquid forms a drop in the hollow portion, the content liquid remaining in the hollow portion can be readily removed by the removal operation. Therefore, a plastic ampule that has even better discharging performance by which no content liquid remains in the hollow portion and that has excellent unsealing performance and easy handling can be provided.

According to the invention pertaining to the plastic ampule described in aspect 11, in addition to the effect of the invention of any one of aspects 8 to 10, because the hollow portion is formed to have a maximum vertical dimension of 5 mm to 13 mm, even when the content liquid forms a drop in the hollow portion, the content liquid remaining in the hollow portion can be further readily removed by the removal operation. Therefore, a plastic ampule that has better discharging performance by which no content liquid remains in the hollow portion and that has excellent unsealing performance and easy handling can be provided.

According to the invention pertaining to the plastic ampule described in aspect 12, in addition to the effect of the invention of any one of aspects 8 to 10, because the hollow portion is formed to have a maximum vertical dimension of 6 mm to 12 mm, even when the content liquid forms a drop in the hollow portion, the content liquid remaining in the hollow portion can be further readily removed by the removal operation. Therefore, a plastic ampule that has even better discharging performance by which no content liquid remains in the hollow portion and that has excellent unsealing performance and easy handling can be provided.

According to the invention pertaining to the plastic ampule described in aspect 13, in addition to the effect of the invention of any one of aspects 8 to 12, because the hollow portion is formed to have a maximum horizontal dimension of 9 mm to 11 mm, even when the content liquid forms a drop in the hollow portion, the content liquid remaining in the hollow portion can be further readily removed by the removal operation. Therefore, a plastic ampule that has better discharging performance by which no content liquid remains in the hollow portion and that has excellent unsealing performance and easy handling can be provided.

According to the invention pertaining to the plastic ampule described in aspect 14, in addition to the effect of the invention of any one of aspects 8 to 13, because the opening portion formed on the head portion when the head portion is cut off from the mouth portion is formed to have an inner diameter of 5 mm to 6 mm, even when the content liquid forms a drop in the hollow portion, the content liquid remaining in the hollow portion can be further readily removed by the removal operation. Therefore, a plastic ampule that has better discharging performance by which no content liquid remains in the hollow portion and that has excellent unsealing performance and easy handling can be provided.

According to the invention pertaining to the plastic ampule described in aspect 15, in addition to the effect of the invention of aspect 14, because the hollow portion is formed to have a minimum vertical dimension equal to or larger than the inner diameter of the opening portion, even when the content liquid forms a drop in the hollow portion, the content liquid remaining in the hollow portion can be further readily removed by the removal operation. Therefore, a plastic ampule that has better discharging performance by which no content liquid remains in the hollow portion and that has excellent unsealing performance and easy handling can be provided.

According to the invention pertaining to the plastic ampule described in aspect 16, because the hollow portion in the head portion is formed to have a bowl shape, and the hollow portion is formed to have a minimum vertical dimension of 4 mm to 10 mm, a maximum vertical dimension of 5 mm to 13 mm, and a maximum horizontal dimension of 9 mm to 11 mm, and the opening portion formed on the head portion when the head portion is cut off from the mouth portion is formed to have an inner diameter of 5 mm to 6 mm, a plastic ampule that has remarkably good discharging performance by which no content liquid remains in the hollow portion and that has excellent unsealing performance and easy handling can be provided.

According to the invention pertaining to the plastic ampule described in aspect 17, in addition to the effect of the invention of any one of aspects 1 to 16, because the material is a polyethylene resin, a plastic ampule with easy handling that is readily unsealed can be provided.

According to the invention pertaining to the plastic ampule described in aspect 18, in addition to the effect of the invention of any one of aspects 1 to 17, because a plurality of the plastic ampules are formed continuously via the thin-wall portion for division to form a plastic ampule block, a plastic ampule that can be mass-manufactured at low cost can be provided.

According to the invention pertaining to the plastic ampule described in aspect 19, in addition to the effect of the invention of aspect 18, because the adjacent plastic ampules are separated between the respective knob portions, the part where each of the plastic ampules is cut off from the plastic ampule block is reduced. Therefore, a plastic ampule that can be readily cut off can be provided.

According to the invention pertaining to the plastic ampule described in aspect 20, in addition to the effect of the invention of any one of aspects 1 to 19, because the part of the head portion that is formed continuously to the cut-off portion is formed to have a wall thickness thicker than that of the cut-off portion, when the knob portion integral with the head portion is twisted at the time of unsealing the plastic ampule, the twisting force can be efficiently transmitted to the cut-off portion, and thus the lower end of the head portion is not deformed. Therefore, a plastic ampule with more improved unsealing performance can be provided.

According to the invention pertaining to the plastic ampule described in aspect 21, in addition to the effect of the invention of aspect 20, because the part of the head portion that is formed continuously to the cut-off portion is formed to have a wall thickness 1.2 times to 1.8 times thicker than the wall thickness of the cut-off portion, when the knob portion integral with the head portion is twisted at the time of unsealing the plastic ampule, the twisting force can be more efficiently transmitted to the cut-off portion, and thus the lower end of the head portion is not deformed. Therefore, a plastic ampule with further improved unsealing performance can be provided.

According to the invention pertaining to the plastic ampule described in aspect 22, in addition to the effect of the invention of aspect 20 or 21, because the part of the head portion formed continuously to the cut-off portion is formed to have almost the same wall thickness as that of the part of the mouth portion formed continuously to the cut-off portion, the head portion gains sufficient hardness, the twisting force can be more efficiently transmitted to the cut-off portion at the time of unsealing, and thus the lower end of the head portion is not deformed. Therefore, a plastic ampule with excellent unsealing performance can be provided.

According to the invention pertaining to the plastic ampule filled with a drug solution described in aspect 23, because the hollow portion in the head portion that is formed continuously to the mouth portion of the body portion is formed to have a bowl shape, the content liquid remaining in the hollow portion of the head portion can be readily dropped into the body portion by the removal operation, and thus a large part of the content liquid can be used, and the content liquid remaining in the hollow portion is not scattered at the time of unsealing. Therefore, the formation can provide a plastic ampule filled with a drug solution having excellent unsealing performance and easy handling.

According to the invention pertaining to the plastic ampule filled with a drug solution described in aspect 24, because the hollow portion in the head portion is formed to have a bowl shape, and the hollow portion is formed to have a minimum vertical dimension of 3 mm to 10 mm, a maximum vertical dimension of 4 mm to 13 mm, and a maximum horizontal dimension of 8 mm to 12 mm, and the opening portion formed on the head portion when the head portion is cut off from the mouth portion is formed to have an inner diameter of 4 mm to 7 mm, a plastic ampule filled with a drug solution that has good discharging performance by which no content liquid remains in the hollow portion and that has excellent unsealing performance and easy handling can be provided.

According to the invention pertaining to the plastic ampule filled with a drug solution described in aspect 25, because the hollow portion in the head portion is formed to have a bowl shape, and the hollow portion is formed to have a minimum vertical dimension of 4 mm to 10 mm, a maximum vertical dimension of 5 mm to 13 mm, and a maximum horizontal dimension of 9 mm to 11 mm, and the opening portion formed on the head portion when the head portion is cut off from the mouth portion is formed to have an inner diameter of 5 mm to 6 mm, a plastic ampule filled with a drug solution that has remarkably good discharging performance by which no content liquid remains in the hollow portion and that has excellent unsealing performance and easy handling can be provided.

According to the invention pertaining to the plastic ampule filled with a drug solution described in aspect 26, in addition to the effect of the invention of aspect 23, because the plastic ampule described in any one of aspects 2 to 6, 8 to 15, and 17 is used, a plastic ampule filled with a drug solution that has better discharging performance by which no content liquid remains in the hollow portion and that has excellent unsealing performance and easy handling can be provided.

According to the invention pertaining to the plastic ampule filled with a drug solution described in aspect 27, in addition to the effect of the invention of aspect 26, because the drug solution is an aqueous injection fluid, a plastic ampule filled with a drug solution that has good discharging performance by which no content liquid remains in the hollow portion and that has excellent unsealing performance and easy handling can be provided.

According to the invention pertaining to the plastic ampule filled with a drug solution described in aspect 28, in addition to the effect of the invention of aspect 26, because the drug solution is an injection suspension or emulsion, a plastic ampule filled with a drug solution that has good discharging performance by which no content liquid remains in the hollow portion and that has excellent unsealing performance and easy handling can be provided.

BRIEF DESCRIPTION OF THE DRAWINGS

FIG. 1(A) is an elevation view of a plastic ampule according to an embodiment of the present invention and FIG. 1(B) is a side view of the plastic ampule according to the embodiment of the present invention.

FIG. 2(A) is a bottom view of the plastic ampule shown in FIG. 1 and FIG. 2(B) is a top view of the plastic ampule shown in FIG. 1.

FIG. 3 is an elevation view showing the cross section of a part of an integrally molded plastic ampule block that is formed continuously from a plurality of the plastic ampules shown in FIG. 1.

FIG. 4(A) is an elevation view showing the cross section of the head portion of the plastic ampule shown in FIG. 1, FIG. 4(B) is an elevation view showing the cross section of the head portion of the conventional plastic ampule shown in FIG. 6, and FIG. 4(C) is an elevation view showing the cross section of the head portion of another conventional plastic ampule.

FIG. 6 is an elevation view showing an integrally molded plastic ampule block that is formed continuously from a plurality of the conventional plastic ampules.

FIG. 7(A) is an elevation view showing the cross section of the vicinity of the cut-off portion of the plastic ampule shown in FIG. 1, FIG. 7(B) is an elevation view showing the cross section of the vicinity of the cut-off portion of the conventional plastic ampule shown in FIG. 4, and FIG. 7(C) is an elevation view showing the cross section of the vicinity of the cut-off portion of the other conventional plastic ampule shown in FIG. 4.

[FIG. 8] FIG. 8 is a table showing the results of the discharging performance test of the plastic ampule according to the embodiment of the present invention and of the conventional plastic ampule.

[FIG 9] FIG. 9 is a table showing the measurement results of each wall thickness of the plastic ampules according to the embodiment of the present invention and of the conventional plastic ampules.

BEST MODES FOR CARRYING OUT THE INVENTION

Figure 1:
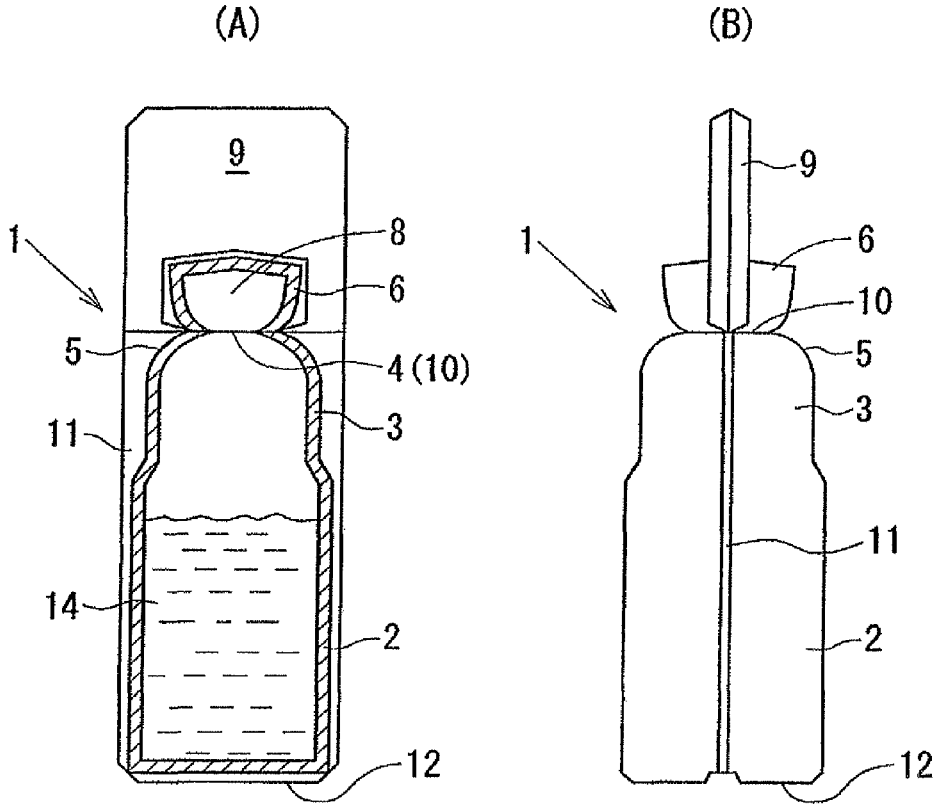
[FIG. 1]

Hereinafter, the plastic ampule according to an embodiment of the present invention will be described based on FIG. 1 to FIG. 4(A).

As shown in FIGS. 1(A) and (B), the plastic ampule 1 according to an embodiment of the present invention is basically composed of a body portion 2, a mouth portion 3 that constitutes an upper part of the body portion 2, a head portion 6 that is formed continuously to the mouth portion 3 via a cut-off portion 10, and a knob portion 9 that gives twisting force to the head portion 6 at the time of unsealing the plastic ampule 1.

Figure 3:
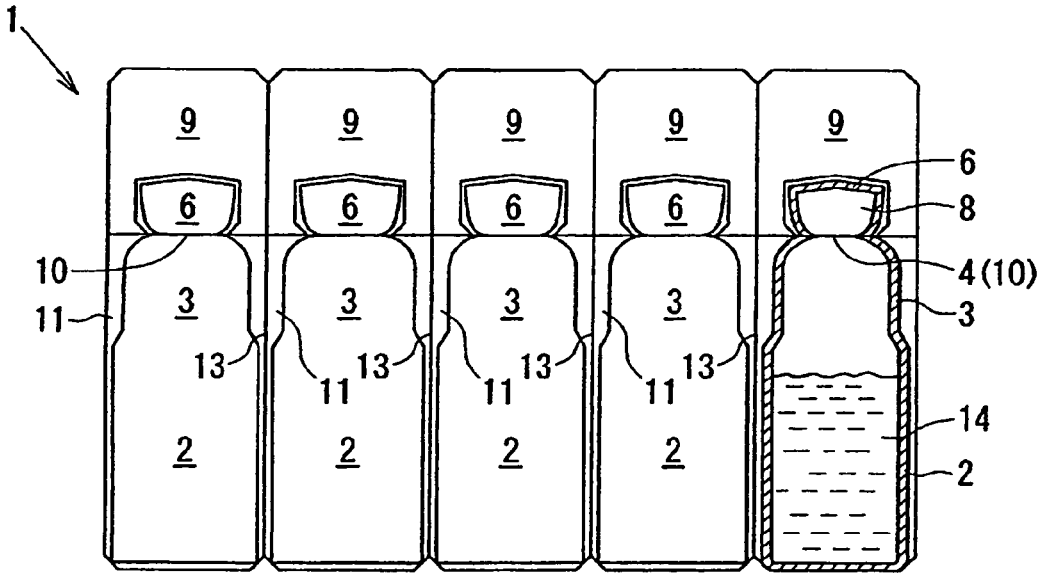
[FIG. 3]
Figure 4:
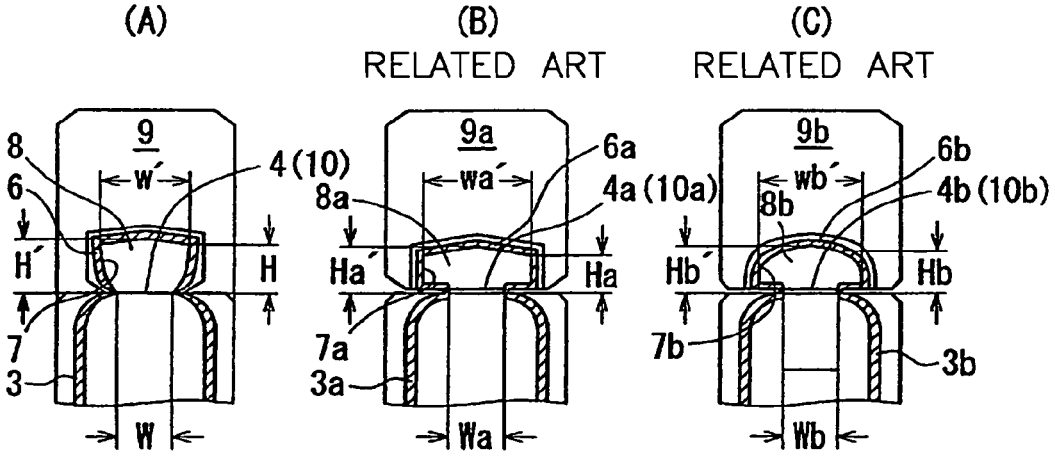
[FIG. 4]

The plastic ampule 1 according to the embodiment of the present invention is usually molded from a polyethylene resin (PE) by blow-fill-seal method, and, as shown in FIG. 3, for example, five plastic ampules are simultaneously molded. The manufacture of the plastic ampules by the blow-fill-seal method is a manufacturing technology conventionally commonly carried out, and thus will not be described in detail (see Japanese Patent Publication No. JP-B-36-5985 and the like).

The embodiment of the present invention will be described based on the plastic ampule 1 shown in FIG. 1, but another embodiment of the present invention may be an ampule preparation filled with a content liquid 14 as the drug solution in such plastic ampule 1 described above. Examples of the content liquid 14 of the plastic ampule filled with a drug solution according to the other embodiment of the present invention include injections such as an aqueous solution, a suspension, and an emulsion, but the content liquid is not specifically limited as far as being usually used as the drug solution. Furthermore, the plastic ampule of the present invention may be used for various applications. The application is not limited to the drug solution, and liquid cosmetics, liquid chemicals (such as a reagent), liquid foods (such as a seasoning), or the like may be filled in the plastic ampule as the content liquid.

Figure 2:
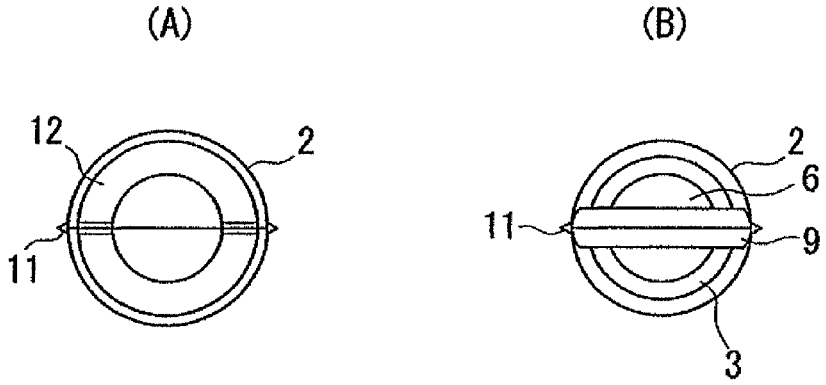
[FIG 2]

Hereinafter, the plastic ampule 1 according to the embodiment of the present invention will be described in detail. As shown in FIG. 1 to FIG. 3, the body portion 2 of the plastic ampule 1 is formed to have a cylinder shape, and the content liquid 14 is filled in the body portion 2. The lower part of the body portion 2 is closed with a bottom portion 12, and the upper part of the body portion 2 has a reduced diameter and continues to the mouth portion 3 with a diameter smaller than that of the body portion 2. The upper part of the mouth portion 3 has a diameter more reduced than that of the mouth portion 3 to form a shoulder portion 5, and the upper end of the shoulder portion 5 continues to the lower end of the head portion 6 via a cut-off portion 10. The body portion 2, the mouth portion 3, and the shoulder portion 5 are integrally reinforced with a connection portion 11. As shown in FIG. 3, the connection portion 11 is formed between the adjacent plastic ampules 1 and 1 when a plastic ampule block constituted of, for example, five plastic ampules 1 is molded by the blow-fill-seal method, and then is divided along a thin-wall portion for division 13 to give each plastic ampule 1.

Figure 7:
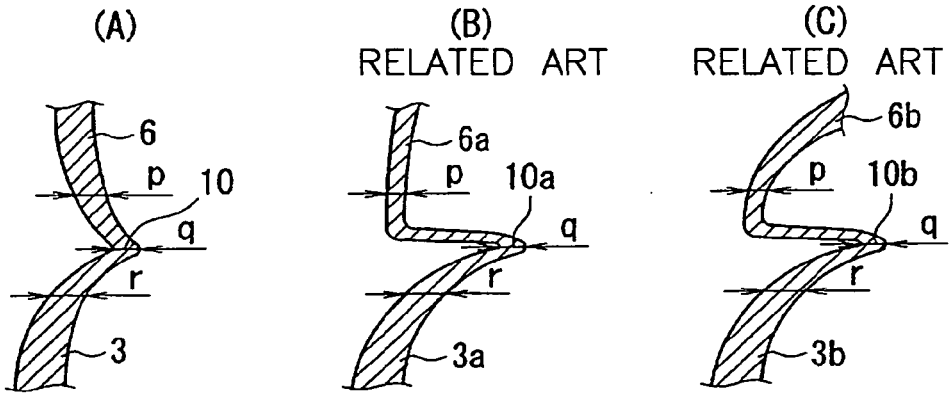
[FIG. 7]

As shown in FIGS. 1(A) and (B), the head portion 6 is formed to have an substantially semispherical bowl shape that is slowly curved from the upper part to the lower part. The lower part of the head portion 6 continues to the upper end of the mouth portion 3 (the upper end of the shoulder portion 5) via the cut-off portion 10. The head portion 6 is surrounded by the knob portion 9 except for the connection portion (the cut-off portion 10) with the mouth portion 3, and the knob portion 9 and the head portion 6 are integrally fused at the time of molding by the blow-fill-seal method as the connection portion 11. The knob portion 9 is formed to have almost the same width (width in the horizontal direction in FIG. 1(A)) as that of the connection portion 11, but the knob portion 9 and the connection portion 11 are separated (along the extension of the cut-off portion 10). In order to lower the center of gravity for stabilization when the plastic ampule 1 is set vertically, the inside of the knob portion 9 is preferably formed to be a hollow structure. Furthermore, when the head portion 6 is formed to have a "bowl shape" by the blow-fill-seal method and the like, as shown in FIG. 7(A), the part of the head portion 6 that is formed continuously to the cut-off portion 10 (near the cut-off portion, for example, the part 1 mm upper from the cut-off portion 10) is formed to have a wall thickness p thicker than the wall thickness q of the cut-off portion 10. On this account, when the knob portion 9 integral with the head portion 6 is twisted with fingers at the time of unsealing the plastic ampule 1, the twisting force can be efficiently transmitted to the cut-off portion 10 without the deformation of the part of the head portion 6 adjacent to the cut-off portion 10 (the lower part of the head portion 6), and thus the unsealing performance of the plastic ampule can be improved. For good unsealing performance, the part of the head portion 6 that is formed continuously to the cut-off portion 10 is preferably formed to have a wall thickness p 1.2 to 1.8 times thicker than the wall thickness q of the cut-off portion 10. Furthermore, the part of the head portion 6 that is formed continuously to the cut-off portion is also preferably formed to have almost the same wall thickness p as the wall thickness r of the part of the mouth portion 3 that is formed continuously to the cut-off portion, and more specifically, the wall thicknesses p and r are set preferably in a range within ±10%.

Furthermore, as shown in FIG. 3, when the plastic ampule block is molded, it is preferable that the knob portions 9 and 9 of the adjacent plastic ampules 1 and 1 are separately formed and thus only the thin-wall portion for division 13 is divided when each of the plastic ampules 1 is divided at the time of using. Then, the hollow portion 8 is formed in the head portion 6, and the lower part of the hollow portion 8 communicates with the mouth portion 5 through an opening portion 4, that is, with the inside space of the body portion 2.

Based on FIG. 4(A), in the plastic ampule 1 having a maximum filling volume of about 5 mL to 20 mL, the inside shape of the hollow portion 8 of the head portion 6 will be further described in detail. It is preferable that the hollow portion 8 is formed to have a "bowl shape" that is almost the same shape as that of the head portion 6 and that the vertical dimension H between the lower end of the hollow portion 8 (corresponding to the opening portion 4 of the head portion 6) and the upper end of the hollow portion 8 (in FIG. 4(A), the position where the maximum dimension W' is obtained in the horizontal direction of the hollow portion 8) (the height of the inner surface 7 of the hollow portion 8, hereinafter called minimum dimension) is set as 3 mm to 10 mm, preferably 4 mm to 10 mm, more preferably 5 mm to 10 mm, and even more preferably 5.5 mm to 8.5 mm so that the content liquid 14 remaining in the hollow portion 8 does not adhere to the inner surface 7 of the hollow portion 8 and is readily discharged by a removal operation.

Figure 5:
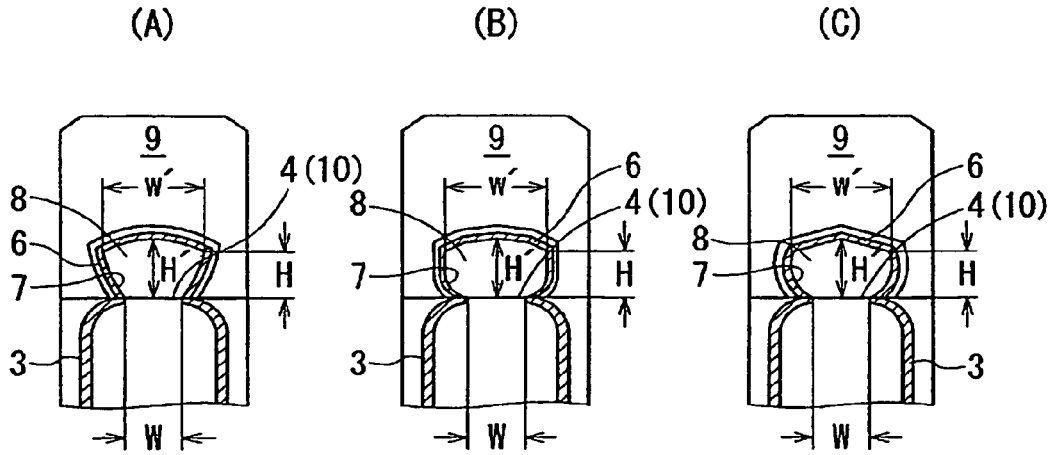
[FIG. 5] Each of FIGS. 5(A), (B), and (C) is an elevation view showing the cross section of the head portion of the plastic ampule according to another embodiment of the present invention.
Figure 6:
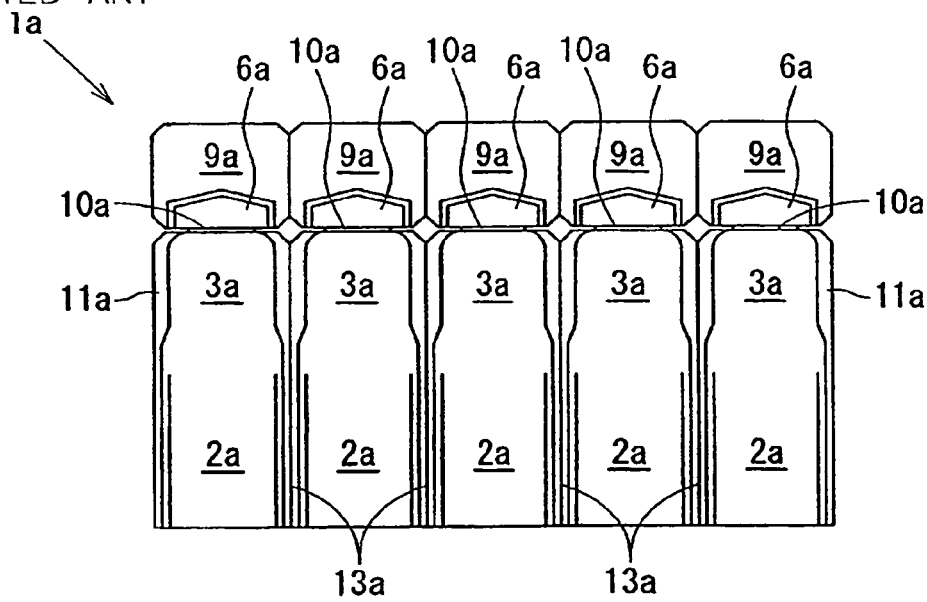
FIG. 6 RELATED ART
[FIG. 6]

Here, in the embodiment of the present invention, the "bowl shape" includes the shapes shown in FIGS. 5(A) to (C) along with that shown in FIG. 4(A), and means the shape including the inner surface 7 that has a substantially arc shape that slowly curves downwardly from the upper end of the inner surface 7 of the hollow portion 8 to the opening portion 4. The inner surface 7 is not necessarily fully curved to form the arc shape and may partly have a straight line portion. The upper inner surface of the hollow portion 8 may have any shape but preferably has the shape protruding upward in order to have as large volume of the hollow portion 8 as possible and in order not to generate an acute corner where the remaining liquid readily adheres to the inner surface of the hollow portion 8. Thus, the vertical dimension (hereinafter called maximum dimension) H' between the lower end of the hollow portion 8 and the top of the upper inner surface of the hollow portion 8 (substantially the center in the horizontal direction of the upper inner surface) may be set as 4 mm to 13 mm, and is preferably set as 5 mm to 13 mm and more preferably 6 mm to 12 mm. The upper inner surface of the hollow portion 8 preferably protrudes upward. That is, the maximum dimension H' is preferably set as equal to or larger than the minimum dimension H.

As shown in FIG. 4(A) and FIGS. 5(A) to (C), one of the features of the plastic ampule according to the embodiment of the present invention is that the hollow portion 8 is formed to have the "bowl shape" as described above. Because the hollow portion 8 is formed to have the bowl shape, even when the content liquid 14 remains in the hollow portion 8, by a simple removal operation, the drop of the content liquid 14 remaining in the hollow portion 8 is smoothly dropped along the shape of the inner surface 7 of the hollow portion 8 to come back from the opening portion 4 into the body portion 2. In this case, when the upper inner surface of the hollow portion 8 protrudes upward, an acute corner where the remaining liquid readily adheres to the inner surface of the hollow portion 8 is not generated, and thus it is more advantageous for discharging the remaining liquid.

Furthermore, in order to reliably get the content liquid 14 remaining in the hollow portion 8 back from the opening portion 4 into the body portion 2, the plastic ampule 1 according to the embodiment of the present invention has a feature that the hollow portion 8 has enough inner space. In the case of conventional plastic ampules, in particular, because the hollow portion 8 has a small vertical dimension, the content liquid 14 adheres to each edge of the hollow portions 8*a* and 8*b* in FIGS. 4(B) and (C) and cannot be discharged. In contrast, in the plastic ampule 1 according to the embodiment of the present invention, the minimum vertical dimension H between the lower end and the upper end of the hollow portion 8 is set as 5 mm or more. The minimum dimension H is preferably 10 mm or less because the head portion 6 including the hollow portion 8 may interfere with twisting the knob portion 9 when the head portion 6 has a too large vertical dimension. Thus, it is one of the features of the present invention that the hollow portion 8 may have a minimum vertical dimension H of 3 to 10 mm and preferably has a minimum vertical dimension H of 4 to 10 mm, more preferably 5 mm to 10 mm, and even more preferably 5.5 mm to 8.5 mm. When the hollow portion 8 has such minimum dimension H, the plastic ampule 1 in which the content liquid 14 remaining in the hollow portion 8 can be readily discharged by a removal operation can be provided.

As described above, in the plastic ampule 1 according to the embodiment of the present invention, because the hollow portion 8 is formed to have the bowl shape, and the minimum dimension H between the lower end and the upper end of the hollow portion 8 is, for example, 5 mm to 10 mm, even when the content liquid 14 remains in the hollow portion 8, by an easy removal operation (the operation of shaking the plastic ampule 1 held with a hand with the head portion 6 up before use so as to remove the remaining content liquid 14 by dropping the remaining liquid 14 into the body portion 2), a drop of the content liquid 14 remaining in the hollow portion 8 is smoothly dropped along the shape of the inner surface 7 of the hollow portion 8 to come back from the opening portion 4 into the body portion 2. Furthermore, when the hollow portion 8 has a larger volume, the discharging performance becomes more reliable. Thus, as shown in FIG. 4(A), the maximum dimension H' between the lower end and the top of the upper inner surface of the hollow portion 8 may be 4 mm to 13 mm, and is preferably set as 5 mm to 13 mm and more preferably 6 mm to 12 mm. When the maximum dimension H' is set in such range, the content liquid 14 remaining in the hollow portion 8 can be reliably dropped from the opening portion 4 into the body portion 2 by the removal operation.

Furthermore, as shown in FIG. 4(A), in the plastic ampule 1 according to the embodiment of the present invention, when the hollow portion 8 has a larger maximum horizontal dimension W' (maximum diameter in the horizontal direction in the hollow portion 8), the hollow portion 8 has a larger volume, and thus the discharging performance becomes reliable. However, because the maximum horizontal dimension W' is preferably smaller than the horizontal dimension of the mouth portion 3 of the plastic ampule 1, the maximum horizontal dimension W' is set as 8 mm to 12 mm and more preferably 9 mm to 11 mm.

Furthermore, in the plastic ampule 1 according to the embodiment of the present invention, as shown in FIG. 4(A), the opening portion 4 at the lower end of the head portion 6 also preferably has an inner diameter W of 4 mm or more. When the inner diameter W of the opening portion 4 is set as 4 mm or more, at the time of the removal operation, the content liquid 14 remaining in the hollow portion 8 is readily dropped from the opening portion 4 into the body portion 2. Furthermore, the minimum dimension H between the lower end and the upper end of the hollow portion 8 is preferably set to be larger than the inner diameter W of the opening portion 4 (including the minimum dimension H=the inner diameter W) because the content liquid 14 remaining in the hollow portion 8 can be reliably dropped into the body portion 2. It is supposed that the opening portion 4 would be better to have a larger inner diameter W. However, when the inner diameter W is larger than 7 mm, after the head portion 6 is twisted and cut off, the content liquid 14 may spill out from the plastic ampule 1 that is tilted to the side or downward when the end of a syringe is inserted from the opening portion 4 into the plastic ampule 1 for drawing the content liquid 14. Therefore, in the plastic ampule 1 according to the embodiment of the present invention, the opening portion 4 preferably has an inner diameter W of 4 mm to 7 mm and more preferably 5 mm to 6 mm.

Next, based on FIG. 8, the evaluation test will be described for comparing the discharging performance of the plastic ampule according to the embodiment of the present invention and of the conventional plastic ampule.

(Discharging Performance Test)

(1) Five plastic ampules shown in FIG. 4(A) (a volume of 5 mL and a content liquid volume of 3 mL) were prepared as the embodiment sample and five plastic ampules shown in FIG. 4(B) (a volume of 5 mL and a content liquid volume of 3 mL) were prepared as the conventional sample. Each content liquid of the embodiment sample and the conventional sample was water and each material of the plastic ampules is polyethylene resin of the same type.

(2) Five examiners A to E carried out the discharging performance test.

(3) The discharging performance test was evaluated as follows: each examiner held the plastic ampule with the head portion down to fill the content liquid in the head portion, then held the plastic ampule with a hand with the head portion up, and shook the plastic ampule once; and then the amount of the content liquid remaining in the head portion was measured.

(Evaluation of Discharging Performance Test)

As shown in FIG. 8, according to four of the examiners A to E, each embodiment sample had a remaining liquid volume smaller than that of the conventional sample. The average remaining liquid volume of the embodiment samples was 0.016 g and the average remaining liquid volume of the conventional samples was 0.027 g.

The result of the discharging performance test in FIG. 8 revealed that the embodiment sample has excellent discharging performance in comparison with the conventional sample.

Next, the evaluation test will be described for comparing the unsealing performance of the plastic ampule according to the embodiment of the present invention and of the conventional plastic ampule.

(Unsealing Performance Test)

(1) Five plastic ampules (a volume of 5 mL) shown in FIG. 4(A) were prepared as the embodiment sample (with a bowl shape) and five plastic ampules (a volume of 5 mL) shown in FIG. 4(B) were prepared as the conventional sample (with a standard shape).

(2) Six examiners carried out the unsealing performance test.

(3) The discharging performance test was evaluated by comparing the "easy-to-unseal" in the sense of each examiner between the embodiment sample and the conventional sample.

(Evaluation of Unsealing Performance Test)

Three of the six examiners evaluated that the embodiment sample was readily unsealed but the remaining three evaluated that the easy-to-unseal did not vary between the embodiment sample and the conventional sample.

(Evaluation by Doctors and Nurses at Medical Institutions)

At five medical institutions, sixteen doctors, nurses, and pharmacists used the embodiment sample to give their impression of use for a hearing.

Summarizing the research results, the impression that the unsealing performance of the embodiment sample was "readily unsealed" was obtained at all of the medical institutions, but, in the commercial product (existing product) having the same shape as that in FIG. 4(B), the impression was that the resin might not be readily cut at the time of unsealing. When the liquid remained in the hollow portion, there was the complaint about scattering the liquid of the commercial product at three institutions, but the embodiment sample of the present invention was evaluated that the liquid was rarely scattered.

The results of the unsealing performance test and the evaluation at the medical institutions revealed that the embodiment sample has excellent unsealing performance by which the liquid is rarely scattered in comparison with the conventional sample.

Both of the plastic ampule according to the embodiment of the present invention and the conventional plastic ampule were manufactured by the blow-fill-seal method, but the obtained result showed that the embodiment sample of the present invention has better unsealing performance than that of the conventional sample. The reason for this will be discussed below.

(Comparison of Wall Thicknesses of Plastic Ampules)

The embodiment sample of the plastic ampule (with a bowl shape) shown in FIG. 4(A) was sliced into cross sections at the cut-off portion 10 and at the positions 1 mm upper and 1 mm lower from the cut-off portion 10, and the wall thickness of each sliced portion was measured under a microscope. Separately, the plastic ampule of the conventional sample (with a standard shape) shown in FIG. 4(B) was sliced in a similar manner to measure each wall thickness. The respective six ampules were measured to calculate the mean value.

(Result of Wall Thickness Measurement)

As shown in FIG. 9, in the embodiment samples of the present invention, the wall thickness p at the upper part from the opening portion (the part of the head portion 6 1 mm upper from the cut-off portion 10) was almost the same as the wall thickness r at the lower part from the opening portion (the part of the mouth portion 5 1 mm lower from the cut-off portion 10). In contrast, in the conventional samples, the wall thickness p at the upper part from the opening portion was smaller than half of the wall thickness r at the lower part from the opening portion. Furthermore, in the conventional samples, the wall thickness p at the upper part from the opening portion was thinner than the wall thickness q at the opening portion (the position at the cut-off portion 10). When the opening portions 4 and 4*a* were observed after unsealing the embodiment sample and the conventional sample, the embodiment sample had the opening portion with an almost round shape but the conventional sample had a deformed opening portion. The results of the wall thickness measurement revealed that the conventional sample had poor unsealing performance because, when the knob portion 9*a* integral with the head portion 6*a* was twisted at the time of unsealing the plastic ampule, the head portion was deformed because of the thin wall thickness, and thus the twisting force was less transferred to the cut-off portion. Furthermore, it was found in the conventional sample that, because the head portion 6*a* was deformed at the time of unsealing, the content liquid remaining in the head portion 6*a* was readily scattered by the action of the deformed head portion 6*a* returning to the original shape immediately after unsealing.

On the other hand, it was revealed that the embodiment sample of the present invention has the feature of excellent unsealing performance and less scattering the remaining liquid because the head portion upper from the opening portion has almost the same sufficient wall thickness as that of the lower part from the opening portion, the head portion 6 does not deform at the time of unsealing, and thus the twisting force is efficiently transferred to the cut-off portion 10.

Here, the embodiment sample of the present invention in FIG. 9 was a trial product made from 10 g of a polyethylene resin and the conventional sample was a trial product made from 11 g of the same resin. Each of the embodiment sample and the conventional sample was the trial product that had the best unsealing performance among products with various resin amounts. In this manner, the embodiment sample of the present invention that has the excellent unsealing performance than that of the conventional sample can be manufactured with a resin amount less than that of the conventional sample and thus has cost advantage.

EXAMPLES

In the plastic ampule 1 shown in FIG. 1 (a volume of 5 mL, a content liquid volume of 3 mL), each size of the hollow portion 8 in the head portion 6 was set as follows [see FIG. 4(A)].

The maximum horizontal dimension W of the hollow portion 8 (the maximum diameter in the horizontal direction of the hollow portion 8): 10 mm; the maximum vertical dimension H' of the hollow portion 8 (the center height in the vertical direction between the lower end and the top of the upper inner surface of the hollow portion 8): 7 mm; the minimum vertical dimension H of the hollow portion 8 (the height of the inner surface 7 of the hollow portion 8): 6 mm; and the inner diameter W of the opening portion 4: 5.5 mm.

Here, the height of the inner surface 7 of the hollow portion 8 was the vertical dimension between the lower end of the hollow portion 8 (corresponding to the opening portion 4 and the cut-off portion 10) and the upper end of the hollow portion 8 (the position where the maximum diameter was obtained in the horizontal direction of the hollow portion 8).

In the plastic ampule 1 according to the example, by the removal operation of shaking the plastic ampule 1 with the content liquid 14 remaining in the hollow portion 8 before use so as to drop the content liquid 14 remaining in the hollow portion 8 into the body portion 2, the content liquid 14 was dropped along the inner surface 7 of the hollow portion 8 to reliably come back from the opening portion 4 into the body portion 2, and thus a large part of the content liquid 14 could be used. As a result, the plastic ampule 1 according to the example was shown that the discharging performance of the content liquid 14 from the hollow portion 8 was improved by forming the hollow portion 8 in the head portion 6 to have the bowl shape with the above sizes. According to the plastic ampule 1, the content liquid 14 remaining in the hollow portion 8 could be reliably discharged and the content liquid 14 remaining in the hollow portion 8 was not scattered at the time of unsealing. Furthermore, the result of the unsealing performance that was actually tested showed that the plastic ampule 1 had better unsealing performance than the conventional sample described in Comparative Example 1 below (see the discharging performance test and the unsealing performance test above).

Furthermore, also in the embodiments shown in FIGS. 5(A) to (C), in a similar manner to that in the embodiment shown in FIG. 4(A), each size of the hollow portion 8 was set as a maximum horizontal dimension W' of the hollow portion 8 (a maximum diameter in the horizontal direction of the hollow portion 8) of 10 mm, a maximum vertical dimension H' of the hollow portion 8 (a center height in the vertical direction between the lower end and the top of the upper inner surface of the hollow portion 8) of 7 mm, a minimum vertical dimension H of the hollow portion 8 (a height of the inner surface 7 of the hollow portion 8) of 6 mm, and an inner diameter W of the opening portion 4 of 5.5 mm.

Here, the height of the inner surface 7 of the hollow portion 8 was, in the embodiments shown in FIGS. 5(A) and (B), the vertical dimension between the lower end of the hollow portion 8 (corresponding to the opening portion 4) and the position where the maximum diameter was obtained in the horizontal direction of the hollow portion 8, and, in the embodiment shown in FIG. 5(C), the vertical dimension between the lower end of the hollow portion 8 (corresponding to the opening portion 4) and the displacement point of the inner surface 7 of the hollow portion 8 (the displaced position of the inner surface 7 from the curve face to the cone face).

As a result, also in the embodiments shown in FIGS. 5(A) to (C), as with the embodiment shown in FIG. 4(A), it was ascertained that the discharging performance of the content liquid 14 from the hollow portion 8 was improved. That is, the content liquid 14 remaining in the hollow portion 8 could reliably be discharged and the content liquid 14 remaining in the hollow portion 8 was not scattered at the time of unsealing.

Comparative Example 1

In the plastic ampule shown in FIG. 4(B) (a volume of 5 mL, a content liquid volume of 3 mL), each size of the hollow portion 8*a* in the head portion 6*a* was set as follows.

The maximum horizontal dimension Wa' of the hollow portion 8*a* (the maximum diameter in the horizontal direction of the hollow portion 8*a*): 10 mm; the maximum vertical dimension Ha' of the hollow portion 8*a* (the center height in the vertical direction): 5 mm; the minimum vertical dimension Ha between the upper end and the lower end of the hollow portion 8*a* (the height of the inner surface 7*a* of the hollow portion 8*a*): 4 mm; and the inner diameter Wa of the opening portion 4*a*: 5.5 mm.

According to the plastic ampule shown in FIG. 4(B), even when a removal operation was carried out in a similar manner to that in Example, the content liquid 14 remaining in the hollow portion 8*a* was kept to adhere to the inner surface 7*a* of the hollow portion 8*a* to remain in the hollow portion 8*a*, and thus the content liquid 14 remaining in the hollow portion 8*a* could not be removed. Furthermore, the unsealing performance test showed the inferior result on the unsealing performance to that of the embodiment sample of the present invention (see the discharging performance test and the unsealing performance test above).

Comparative Example 2

In the plastic ampule shown in FIG. 4(C) (a volume of 5 mL, a content liquid volume of 3 mL), each size of the hollow portion 8*b* in the head portion 6*b* was set as follows.

The maximum horizontal dimension Wb' of the hollow portion 8*b* (the lower end peripheral part of the inner surface 7*b* of the hollow portion 8*b*): 10 mm; the maximum vertical dimension Hb' of the hollow portion 8*b* (the center height in the vertical direction): 5 mm; the minimum vertical dimension Hb between the upper end and the lower end of the hollow portion 8*b* (the height of the inner surface 7*b* of the hollow portion 8*b*): 4 mm; and the inner diameter Wb of the opening portion 4*b*: 5.5 mm.

Here, the minimum vertical dimension Hb between the upper end and the lower end of the hollow portion 8*b* (the height of the inner surface 7*b* of the hollow portion 8*b*) was the vertical dimension between the inner peripheral edge of the opening portion 4*b* (cut-off portion 10*b*) and the intersection of the vertical line from the inner peripheral edge and the inner surface 7*b*.

According to the plastic ampule shown in FIG. 4(C), even when the removal operation was carried out in a similar manner to that in Example, the content liquid 14 remaining in the hollow portion 8*b* was kept to adhere to the inner surface 7*b* of the hollow. portion 8*b* to remain in the hollow portion 8*b* as with Comparative Example 2, and thus the content liquid 14 remaining in the hollow portion 8*b* could not be removed.

Description of the Reference Numerals

1, 1*a*: plastic ampule, 2, 2*a*: body portion, 3, 3*a*, 3*b*: mouth portion, 4, 4*a*, 4*b*: opening portion, 5: shoulder portion, 6, 6*a*, 6*b*: head portion, 7, 7*a*, 7*b*: inner surface, 8, 8*a*, 8*b*: hollow portion, 9, 9*a*, 9*b*: knob portion, 10, 10*a*, 10*b*: cut-off portion, 11,11*a*: connection portion, 12: bottom portion, 13, 13*a*: thin-wall portion for division, 14: content liquid, p: wall thickness of the part of the head portion that is formed continuously to the cut-off portion, q: wall thickness of the cut-off portion, r: wall thickness of the part of the mouth portion that is formed continuously to the cut-off portion

The invention claimed is:

1. A plastic ampule comprising:

a body portion substantially formed of a cylinder shape;

a head portion substantially formed of a semispherical bowl shape continuously to a mouth portion of the body portion via a cut-off portion; and a part of the head portion that is formed continuously to the cut-off portion has a wall thickness thicker than a wall thickness of the cut-off portion; and a knob portion formed continuously to the head portion, wherein the plastic ampule is unsealed by twisting the knob portion and cutting the head portion off the mouth portion at the cut-off portion, an upper part of the mouth portion has a smaller diameter than a lower part of the mouth portion to form a shoulder portion, a curved inner portion of the upper part of the mouth portion decreases in diameter as the curved inner portion approaches the cut-off portion, and a substantially arc-shaped inner surface of a hollow portion in the head portion decreases in diameter as the arc-shaped inner surface approaches the cut-off portion, such that the inner surface of the hollow portion in the head portion and the inner surface of the mouth portion have equivalent diameters at the cut-off portion.

2. The plastic ampule according to claim 1, wherein the part of the head portion formed continuously to the cut-off portion has a wall thickness of substantially 1.2 times to 1.8 times thicker than the wall thickness of the cut-off portion.

3. The plastic ampule according to claim 1, wherein the hollow portion has a minimum vertical dimension of 3 mm to 10 mm, a maximum vertical dimension of substantially 4 mm to 13 mm, and a maximum horizontal dimension of substantially 8 mm to 12 mm, and an opening portion formed on the head portion when the head portion is cut off from the mouth portion has an inner diameter of substantially 4 mm to 7 mm.

4. The plastic ampule according to claim 1, wherein the hollow portion has a minimum vertical dimension of 4 mm to 10 mm, a maximum vertical dimension of substantially 5 mm to 13 mm, and a maximum horizontal dimension of substantially 9 mm to 11 mm, and an opening portion formed on the head portion when the head portion is cut off from the mouth portion has an inner diameter of substantially 5 mm to 6 mm.

5. The plastic ampule according to claim 1, wherein the plastic ampule is manufactured by a blow-fill-seal method.

6. The plastic ampule according to claim 5, wherein a plastic ampule block is formed by continuously forming a plurality of the plastic ampules via a thin-walled portion for division.

7. A plastic ampule filled with a drug solution comprising:

a body portion substantially formed of a cylinder shape;

a head portion substantially formed of a semispherical bowl shape continuously to a mouth portion of the body portion via a cut-off portion; and a part of the head portion that is formed continuously to the cut-off portion has a wall thickness thicker than a wall thickness of the cut-off portion; and a knob portion formed continuously to the head portion, wherein the plastic ampule is unsealed by twisting the knob portion and cutting the head portion off from the mouth portion at the cut-off portion, an upper part of mouth portion decreases in diameters than the mouth portion to form a shoulder portion, a curved inner surface of the upper part of the mouth portion decreases in diameter as the curved inner surface approaches the cut-off portion, and a substantially arc-shaped inner surface of a hollow portion in the head portion decreases in diameter as the arc-shaped inner surface approaches the cut-off portion, such that the inner surface of the hollow portion in the head portion and the inner surface of the mouth portion have equivalent diameters at the cut-off portion.

8. The plastic ampule filled with a drug solution according to claim 7, wherein the part of the head portion formed continuously to the cut-off portion has a wall thickness of substantially 1.2 times to 1.8 times thicker than the wall thickness of the cut-off portion.

9. The plastic ampule filled with a drug solution according to claim 7, wherein the hollow portion has a minimum vertical dimension of 3 mm to 10 mm, a maximum vertical dimension of substantially 4 mm to 13 mm, and a maximum horizontal dimension of substantially 8 mm to 12 mm, and an opening portion formed on the head portion when the head portion is cut off from the mouth portion has an inner diameter of substantially 4 mm to 7 mm.

10. The plastic ampule filled with a drug solution according to claim 7, wherein the hollow portion has a minimum vertical dimension of 4 mm to 10 mm, a maximum vertical dimension of substantially 5 mm to 13 mm, and a maximum horizontal dimension of substantially 9 mm to 11 mm, and an opening portion formed on the head portion when the head portion is cut off from the mouth portion has an inner diameter of substantially 5 mm to 6 mm.

11. The plastic ampule filled with a drug solution according to claim 7, wherein the plastic ampule is manufactured by a blow-fill-seal method.

12. The plastic ampule filled with a drug solution according to claim 11, wherein a plastic ampule block is formed by continuously forming a plurality of the plastic ampules via a thin-walled portion for division.

* * * * *